US006107581A

United States Patent [19]

Tanigawa et al.

[11] Patent Number: 6,107,581

[45] Date of Patent: Aug. 22, 2000

[54] CIRCUIT BREAKING DEVICE

[75] Inventors: Mitsuru Tanigawa; Jun Yasukuni, both of Yokkaichi; Yoshiyuki Miyazaki; Akio Matsumaru, both of Nagoya, all of Japan

[73] Assignees: Harness System Technologies Research, Ltd., Nagoya; Sumitomo Wiring Systems, Ltd., Mie; Sumitomo Electric Industries, Ltd., Osaka, all of Japan

[21] Appl. No.: 09/247,860

[22] Filed: Feb. 11, 1999

[30] Foreign Application Priority Data

Feb. 17, 1998 [JP] Japan ..... 10-035111
Feb. 17, 1998 [JP] Japan ..... 10-035116

[51] Int. Cl.[7] ..... H01H 35/38

[52] U.S. Cl. ..... 200/82 D; 337/401

[58] Field of Search ..... 200/82 D, 82 R; 337/401

[56] References Cited

U.S. PATENT DOCUMENTS

| | | | |
|---|---|---|---|
| 1,576,228 | 3/1926 | Schmie . | |
| 3,947,648 | 3/1976 | Muterel | 200/82 D |
| 4,004,839 | 1/1977 | Burgdorf | 303/6 C |
| 4,149,093 | 4/1979 | D'Alessio et al. | 307/10 BP |
| 5,187,337 | 2/1993 | Fujie et al. | 200/82 R |

FOREIGN PATENT DOCUMENTS

| | | |
|---|---|---|
| 0 627 752 A1 | 7/1994 | European Pat. Off. . |
| 0 791 942 A2 | 8/1997 | European Pat. Off. . |
| 84 33 042 | 2/1986 | Germany . |
| 92 00 034 | 4/1992 | Germany . |
| 94 01 486 | 5/1994 | Germany . |
| 196 06 448 A1 | 8/1997 | Germany . |
| 198 30 152 A1 | 3/1999 | Germany . |
| 58-47809 | 10/1983 | Japan . |
| 9-509524 | 9/1997 | Japan . |
| WO 95/21454 | 8/1995 | WIPO . |
| WO 97/37873 | 10/1997 | WIPO . |

*Primary Examiner*—Michael L. Gellner
*Assistant Examiner*—Nhung Nguyen
*Attorney, Agent, or Firm*—Oliff & Berridge, PLC

[57] ABSTRACT

A circuit breaking device includes a socket provided on the way of a circuit, a plug movably disposed in a direction that the plug is inserted into and removed from the socket, an explosive exploding in response to a trigger signal given thereto to thereby drive the plug by explosion force to move advanced, and the plug which is normally disposed in a retreated position at where the plug is in a conductive state with said socket, while the plug is in a non-conductive state with said socket when the plug moves to an advanced position.

19 Claims, 13 Drawing Sheets

CIRCUIT BREAKING DEVICE

BACKGROUND OF THE INVENTION

1. Field of the Invention

The present invention relates to a circuit breaking device provided in a car or the like.

2. Description of the Related Art

As for such a circuit breaking device, it is general to use a fuse or a fusible link which is fused to break a circuit when an overcurrent is generated in the circuit. On the other hand, in such an emergency where, for example, an accident is caused in a vehicle, there is a case where it is demanded to forcibly break a circuit immediately. Such a request is particularly earnest, for example, in power supply circuits and soon in electric vehicles which have come into wide use promptly in recent years.

As for such a conventional circuit breaker, JP-B-58-47809 discloses a circuit breaker for breaking a conductor inserted into a circuit by use of an explosion force of an explosive. According to this circuit breaker, as shown in FIG. 17, a fuse 202 connected between output terminals 201, an explosive 203, and a filament 204 for heating this explosive 203 are enclosed in a reinforced enclosure glass 205. When a current is supplied between input terminals 206, the filament 204 is heated to thereby explode the explosive 203. Thus, the fuse 202 is broken by use of the explosion force. It is therefore possible to break the circuit forcibly at desired timing.

However, since the fuse 202 is broken by the explosion force of the explosive itself, such a circuit breaker has been somewhat short in reliability in view of breaking of the fuse 202 surely, therefore, in view of expectation for sure circuit breaking.

SUMMARY OF THE INVENTION

The present invention has been made on the foregoing situation, and it is an object thereof to provide a circuit breaking device which can perform emergency breaking surely in spite of the fact of using explosion force of an explosive.

As means for achieving the above object, according to a first aspect of the present invention, there is a feature that a circuit breaking device comprises a socket provided on the way of a circuit, a plug disposed so as to be movable advanced and retreated in such a direction that the plug is inserted into and removed from the socket, and an explosive exploding in response to a trigger signal given thereto to thereby drive the plug by explosion force to move advanced, wherein the plug is normally disposed in a retreated position in which the plug is in a conductive state with the socket, while the plug is in a non-conductive state with the socket when the plug moves to the advanced position.

When the explosive explodes in response to the trigger signal, the plug moves to the advanced position in response to the explosion force to a non-conductive state with the socket, so that the circuit is broken. The conduction is cut by the movement of the plug relative to the socket, while the explosion force of the explosive is used. Accordingly, it is possible to perform circuit breaking with high reliability.

According to a second aspect of the present invention, there is a feature that, in the circuit breaking device according to a first aspect of the present invention, the plug includes a conductor portion and an insulating portion provided continuously so that the conductor portion is connected to the socket when the plug is disposed in the retreated position, while the insulating portion is contacted to the socket when the plug is disposed in the advanced position.

When the plug moves to the advanced position, the insulating portion provided in the plug is contacted to the socket, so that the plug comes into a non-conductive state. Since the conduction is cut through the insulating portion having a high insulating resistance, it is possible to disposed the plug in the non-conductive state more surely.

According to a third aspect of the present invention, there is a feature that, in the circuit breaking device according to a first aspect of the present invention, the device further comprises detent means for locking the plug in a state of detention when the plug moves to the advanced position.

When the plug moves to the advanced position, the plug is restrained from returning to the retreated position by said detent means. Accordingly, it is possible to prevent the plug and the socket from recovering the conductive state.

According to a fourth aspect of the present invention, there is a feature that, in the circuit breaking device according to a third aspect of the present invention, when a force greater than or equal to a predetermined force is made to act on the plug, said detent means releases its lock to allow the plug to return the retreated position.

For example, when the head of the plug is pushed in, the plug is returned to the retreated position while the locking of said detent means is released, so that conduction is made between the plug and the socket, that is, the connection of the circuit is recovered.

According to a fifth aspect of the present invention, there is a feature that, a circuit breaking device comprises a socket provided on the way of a circuit, a plug removably inserted into the socket, and disposed so as to be movable advanced and retreated between a conductive position where the plug is brought into conduction with the socket and a non-conductive position where the plug is brought into non-conduction with the socket; urging means for urging the plug to move toward the non-conductive position; lock means for locking the plug in the conductive position against urging force of said urging means; and release means for releasing the plug from lock by said lock means in response to a trigger signal given thereto.

Upon reception of a trigger signal, said release means operates to release the plug from lock by said lock means. As a result, the plug is moved to the non-conductive position by the urging force of said urging means so as to be brought into a non-conductive state. Thus, the circuit is broken. The conduction is cut by the movement of the plug relative to the socket by use of the urging force of said urging means. Accordingly, it is possible to perform circuit breaking with a high reliability and at a high speed.

According to a sixth aspect of the present invention, there is a feature that, in the circuit breaking device according to a fifth aspect of the present invention, the plug includes a conductor portion and an insulating portion which are provided continuously so that the conductor portion is connected to the socket when the plug is disposed in the conductive position, while the insulating portion is contacted to the socket when the plug is disposed in the non-conductive position.

When the plug moves to the non-conductive position, the insulating portion provided in the plug is contacted to the socket so that the plug is brought into a non-conductive state. Since the conduction is cut through the insulating portion having a high insulating resistance, it is possible to bring the plug into a non-conductive state more surely.

According to a seventh aspect of the present invention, there is a feature that, in the circuit breaking device according to a fifth aspect of the present invention, the plug can be locked in the conductive position again by said lock means when the plug is pushed from the non-conductive position.

The plug is locked in the conductive portion again by pushing it into socket, the conduction between the plug and the socket is recovered.

The present disclosure relates to the subject matter contained in Japanese patent application Nos. Hei. 10-35116 (filed on Feb. 17, 1998) and Hei. 10-35111 (filed on Feb. 17, 1998) which are expressly incorporated herein by reference in its entirely.

DETAILED DESCRIPTION OF THE PREFERRED EMBODIMENTS

Figure 1:
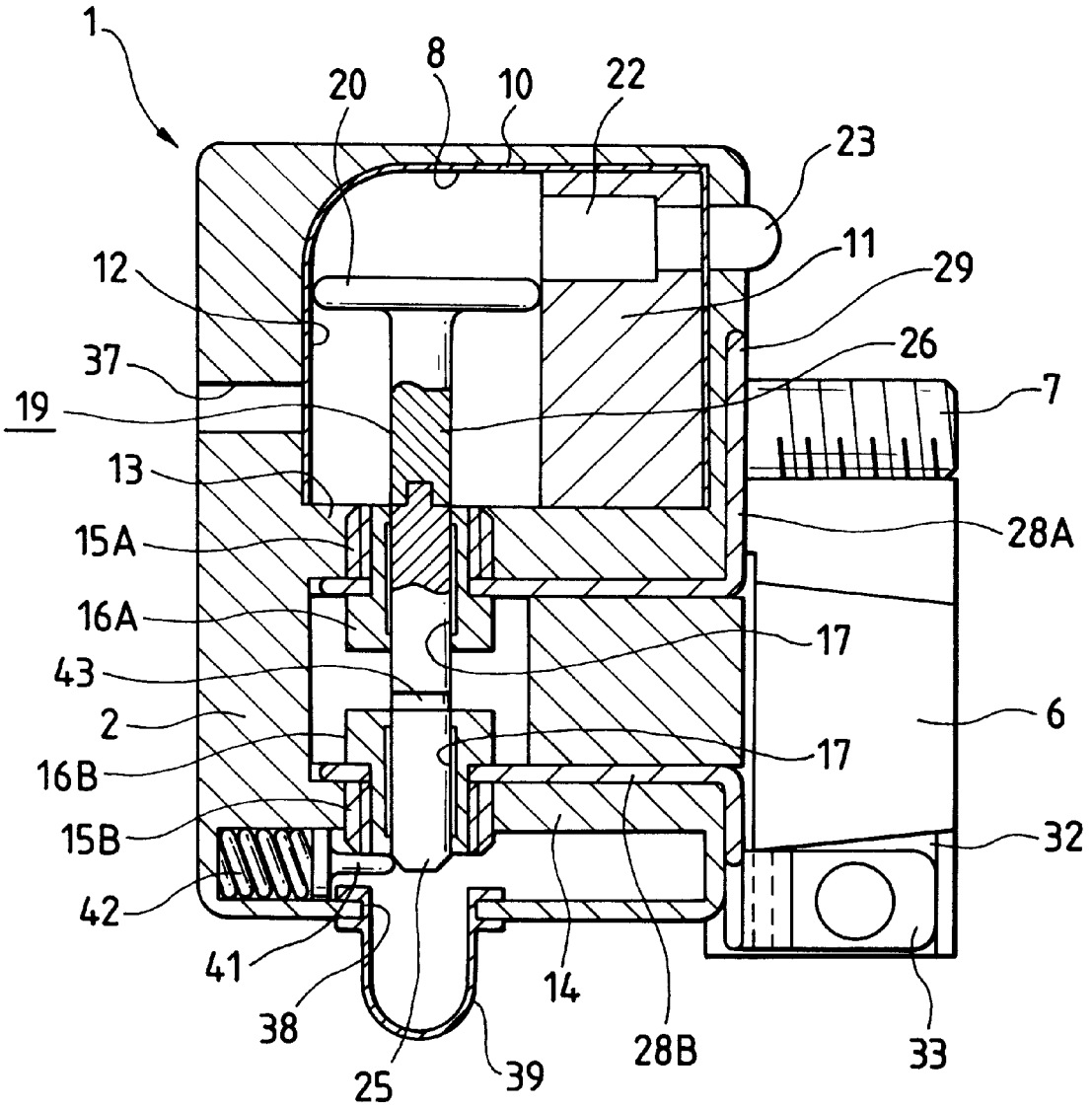
FIG. 1 is a sectional view when a plug of a first embodiment of the present invention is disposed in a retreated position.

Embodiments in which the present invention is applied to a power supply circuit of an electric vehicle will be described with reference to the accompanying drawings.

First Embodiment

A first embodiment of the present invention will be described with reference to FIG. 1 to FIG. 3.

In the drawings, the reference numeral 1 represents a body casing which is made of synthetic resin and has such a shape that a post mounting plate 3 is provided so as to project from one side surface of a flat block portion 2 perpendicularly thereto. An insertion hole to which a battery post 5 (see FIG. 3) of a battery (not-shown) mounted on an electric vehicle will be inserted is formed in the post mounting plate 3. A fastening ring 6 made of a conductor is disposed thereon. Further, a stud bolt 7 for connecting a not-shown power supply wire is erected on a side surface of the block portion 2.

A storage space 8 is formed inside the block portion 2 on the upper side of FIG. 1, and a casing 10 is stored in the space 8. The casing 10 is made of stainless steel or the like. A housing 11 is disposed on the right side inside the casing 10, so that a sliding guide hole 12 is formed on the left side. A partition wall 13 is formed on a bottom portion of the storage space 8, and another partition wall 14 is formed in a position thereunder and separated at a predetermined interval therefrom. Connection rings 15A and 15B each made of a conductor are fixed to the partition walls 13 and 14 respectively on the center axis of the above-mentioned sliding guide hole 12. Sockets 16A and 16B each made of a conductor and shaped into a flanged cylinder are fitted into the connection rings 15A and 15B respectively.

These sockets 16A and 16B are formed like louver terminals in which pieces of louvers 17 elastically swollen inward elastically are provided at intervals in the circumferential on the inner surfaces of the sockets 16A and 16B. The sockets 16A and 16B are fixed in such a manner that the upper socket 16A is screwed into the connection ring 15A from its lower surface side while the lower socket 16B is screwed into the connection ring 15B from its upper surface side.

A plug 19 is slidably fitted between the both sockets 16A and 16B. A piston 20 is formed on the upper end of the plug 19 and slidably fitted into the above-mentioned sliding guide hole 12, so that the piston 20 can move between the retreated position shown in FIG. 1 and the advanced position shown in FIG. 2.

An explosive seal portion 22 which will be a driving source of the plug 19 is stored in the housing 11 inside the casing 10. This explosive seal portion 22 is designed so that an explosive is disposed around a filament and filled in a seal member. The explosive seal portion 22 is stored sideways pointing a space above the piston 20 when the plug 19 is disposed in the retreated position, as shown in FIG. 1. A trigger wire 23 for feeding a current to the filament is connected to the explosive seal portion 22, led to the outside of the body casing 1, and connected to the battery.

On the other hand, the plug 19 is formed from a conductor portion 25 made of conductive material only at a front end portion and an insulating portion 26 made of insulating material at a base end portion. Therefore, the conductor portion 25 enters the sockets 16A and 16B to extend over the both sockets 16A and 16B when the plug 19 is brought into the retreated position shown in FIG. 1, and the insulating portion 26 gets into the upper socket 16A over its whole length when the plug 19 is brought into the advanced position shown in FIG. 2.

Bus bars 28A and 28B are connected to the upper and lower sockets 16A and 16B respectively. The bus bars 28A and 28B are made of copper alloy or the like. The upper bus bar 28A is formed by bending at a right angle, and provided with a connection portion 29 with a fitting hole 30 formed on the outer end side. Further, the fitting hole 30 is penetrated by the stud bolt 7 while the connection portion 29 is abutted on the erected surface of the stud bolt 7. On the other hand, the inner end side reaches the lower surface of the connection ring 15A along the lower surface of the partition wall 13, and is fastened together with the upper socket 16A so as to be connected to the socket 16A when the socket 16A is screwed in.

On the other hand, the inner end side of the lower bus bar 28B is fastened together with the lower socket 16B so as to be connected to the socket 16B when the socket 16B is screwed into the connection ring 15B. The outer end side of the lower bus bar 28B projects to the outside of the block portion 2 along the upper surface of the partition wall 14, and thereafter reaches near a connection plate 32 of the above-mentioned fastening ring 6 along the post mounting plate 3. A connection portion 33 provided so as to rise at the front end of the lower bus bar 28B is provisionally connected to the connection plates 32 by means of a bolt 34 and a nut 35 for fastening the latter.

In the inner circumferential surface of the above-mentioned sliding guide hole 12 of the piston 20, a vent hole 37 is formed to open in the outer surface of the block portion 2 at a place above the place where the piston 20 is disposed when the plug l9 is disposed in the advanced position. Further, an escape hole 38 is formed in a position corresponding to the front end of the plug 19 on the lower wall of the block portion 2, and closed by a button cap 39 made of rubber.

Further, a stopper 41 movable forward and backward toward the area where the plug 19 can slide is provided on the lower end in the block portion 2. This stopper 41 is normally urged by means of the urging force of an urging spring 42 so that the front end of the stopper 41 projects to the area where the plug 19 can slide. On the other hand, a lock groove 43 is provided circumferentially in the middle of the conductor portion 25 of the plug 19. The stopper 41 is designed so that the stopper 41 is locked in a front-end corner portion of the plug 19 when the plug 19 is disposed in the retreated position, while the stopper 41 is locked in the lock groove 43 when the plug 19 is disposed in the advanced position.

The body casing 1 mentioned above is assembled on the battery. Then, the plug 19 is brought in the retreated position in advance. Describing the procedure, the post mounting plate 3 is abutted on against the erected surface of the battery post 5 while the battery post 5 is inserted into the fastening ring 6 through the insertion hole. When the bolt 34 and the nut 35 are fastened, the fastening ring 6 is diminished in diameter and fixed to the battery post 5. At the same time, the battery post 5 and the connection portion 33 of the lower bus bar 28B are connected to each other through the fastening ring 6. Further, a connection terminal of a not-shown power supply wire is fitted to the stud bolt 7, and the connection terminal is pressed and fixed to the connection portion 29 of the upper bus bar 28A by a nut (not-shown). Thus, there is formed a power supply circuit starting from the battery post 5 to the power supply wire through the lower bus bar 28B and socket 16B, the conductor portion 25 of the plug 19, and the upper socket 16A and bus bar 28A. Further, the trigger wire 23 is also connected to the battery side. The body casing 1 is covered with a cover.

This first embodiment has such a structure as mentioned above. The operation of the first embodiment is described as follows:

When an abnormal signal is sent out with generation of an accident or the like in the vehicle in the state of FIG. 1, a current flows in the trigger wire 23. As a result, the filament in the explosive seal portion 22 generates heat, so that the explosive explodes. The explosion force acts on the upper surface of the piston 20 so that the plug 19 is moved downward while the stopper 41 moves laterally against the urging force of the urging spring 42. Then, the plug 19 reaches the advanced position, as shown in FIG. 2. Then, the stopper 41 moves laterally again by the urging force so that the stopper 41 is fitted and locked in the lock groove 43. When the plug 19 reaches the advanced position, the insulating portion 26 thereof enters the upper socket 16A, so that the plug 19 and the upper socket 16A are brought into a non-conductive state with each other. Accordingly, the power supply circuit is broken.

Therefore, in this first embodiment, the plug 19 is moved relatively to the sockets 16A and 16B by the explosion force of the explosive to thereby cut the conduction. Accordingly, it is possible to break the power supply circuit with a high reliability. Further, since the conduction is cut off through the insulating portion 26, it is possible to produce a non-conductive state more surely.

Further, when the plug 19 moves to the advanced position, the plug 19 is locked by the stopper 41. Therefore, the plug 19 is prevented from returning to the retreated position regardless of the direction of attachment. Accordingly, unexpected recovery of conduction is prevented.

Figure 2:
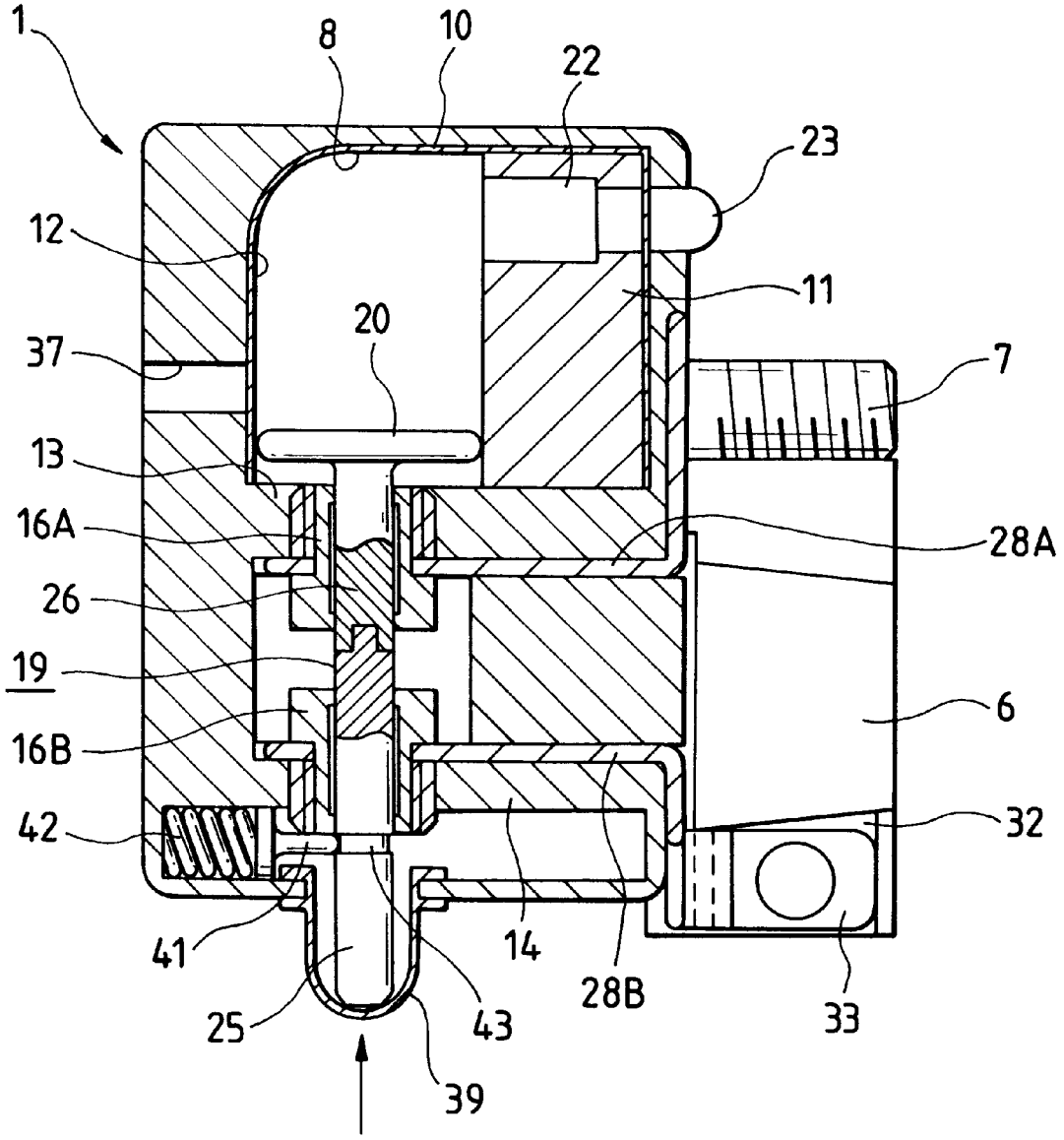
FIG. 2 is a sectional view when the plug is disposed in an advanced position.
Figure 3:
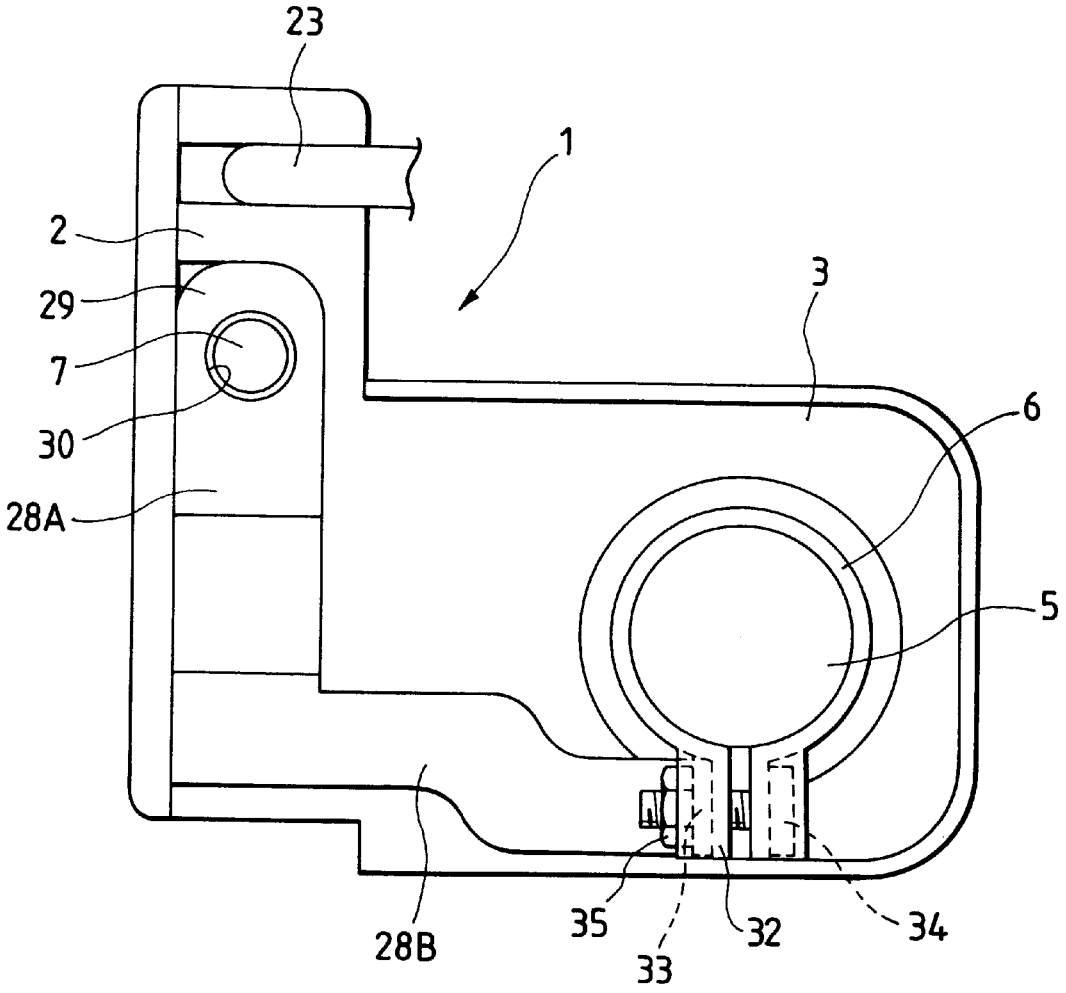
FIG. 3 is a side view.

On the other hand, when the plug 19 is pushed through the button cap 39 in as shown by the arrow in FIG. 2, the plug 19 can be returned to its original retreated position while the stopper 41 moves laterally. Therefore, it is possible to recover the conduction of the circuit.

Second Embodiment

A second embodiment of the present invention will be described with reference to FIG. 4 to FIG. 7. Portions having the same functions as those in the first embodiment are referenced correspondingly, and their description will be omitted or made simply.

A body casing 51 made of synthetic resin has such a shape that a post mounting plate 53 is provided to project from one side surface of a flat block portion 52 perpendicularly thereto. The fastening ring 6 for fastening and fixing the battery post 5 inserted thereto is disposed on the post mounting plate 53. On the other hand, the stud bolt 7 for connecting a power supply wire is erected on a side surface of the block portion 52.

Figure 4:
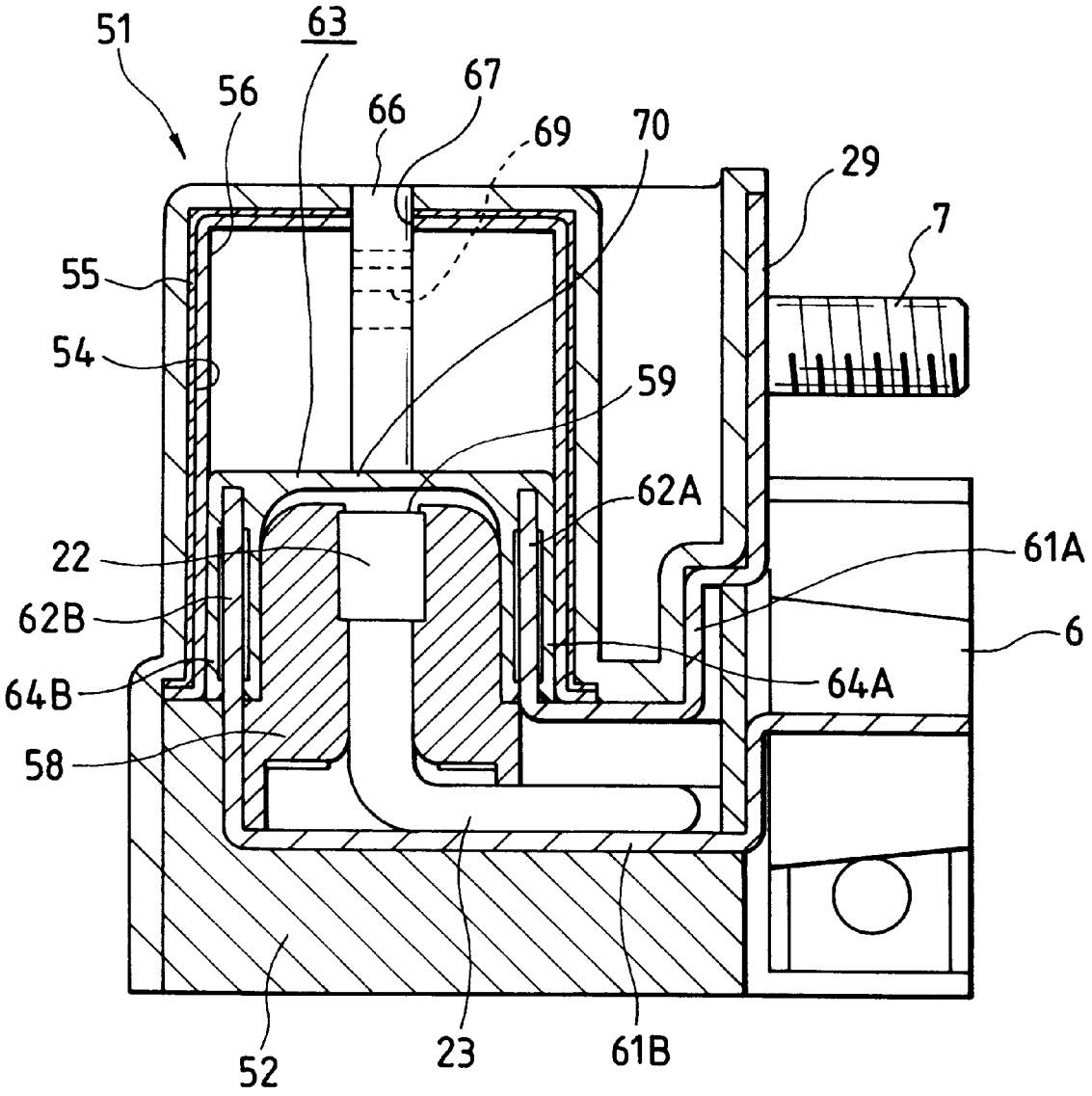
FIG. 4 is a sectional view when a plug of a second embodiment is disposed in a retreated position.

A storage chamber 54 is formed on the upper side of FIG. 4 in the block portion 52, and a casing 55 made of stainless steel and having a sectional shape like a gate is stored therein. A lining 56 consisting of insulating material such as synthetic resin or the like is formed in the inner surface of the casing 55. A housing 58 storing the explosive seal portion 22 is disposed on the lower end side inside the casing 55. An opening 59 communicating with the explosive seal portion 22 is formed in the upper surface of the housing 58. The trigger wire 23 connected to the explosive seal portion 22 is led from the block portion 52 so as to be connected to the battery.

Socket portions 62A and 62B formed from inner end portions of a pair of bus bars 61A and 61B are disposed at a predetermined distance on the opposite sides of the housing 58. A connection portion 29 provided on an outer end portion of one of the bus bars 61A (right one in FIG. 4) is disposed in the erected surface of the stud bolt 7, while a connection portion 33 provided on an outer end portion of the other bus bar 61B is provisionary connected to the connection plate 32 of the fastening ring 6.

Figure 5:
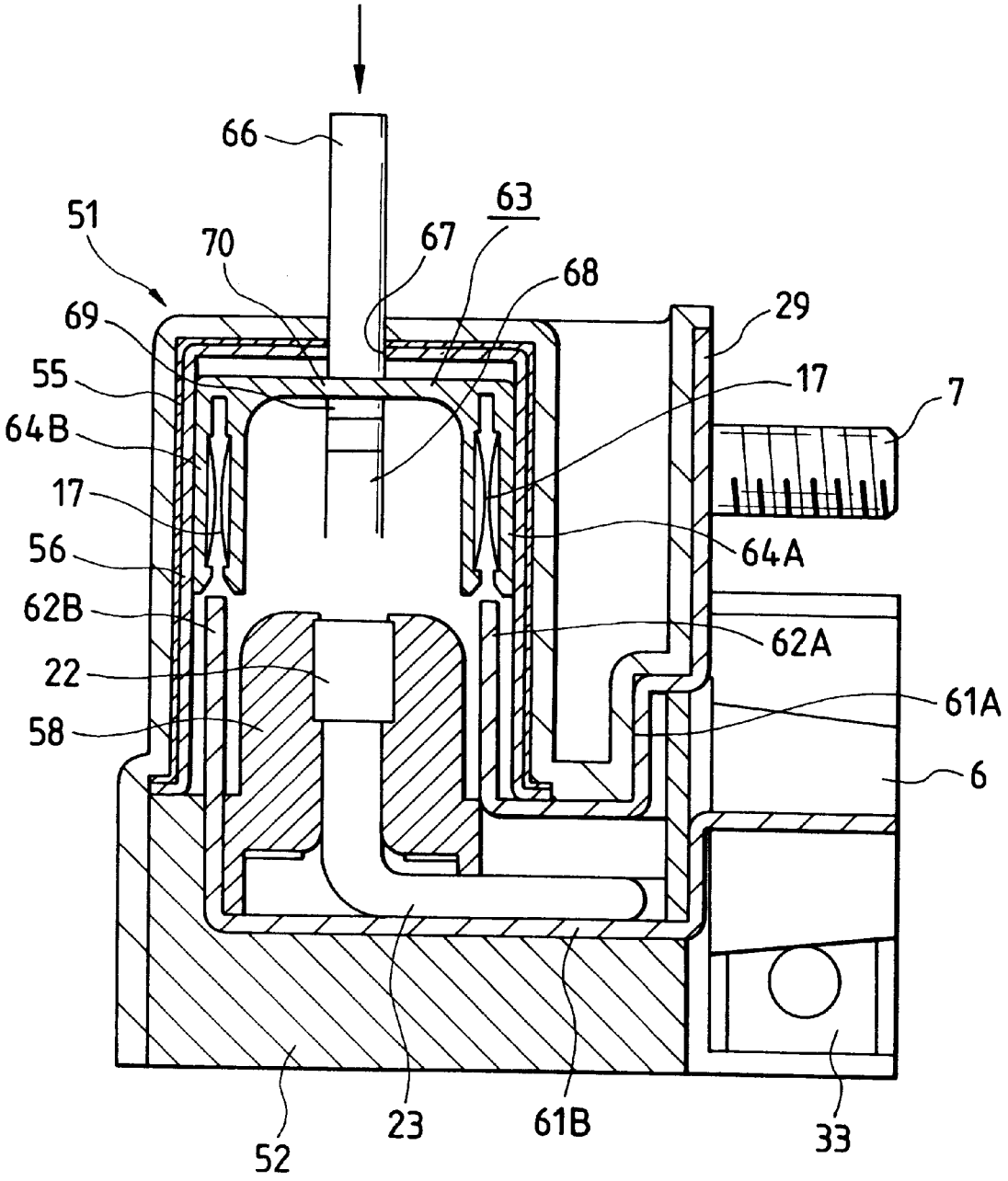
FIG. 5 is a sectional view when the plug is disposed in an advanced position.
Figure 6:
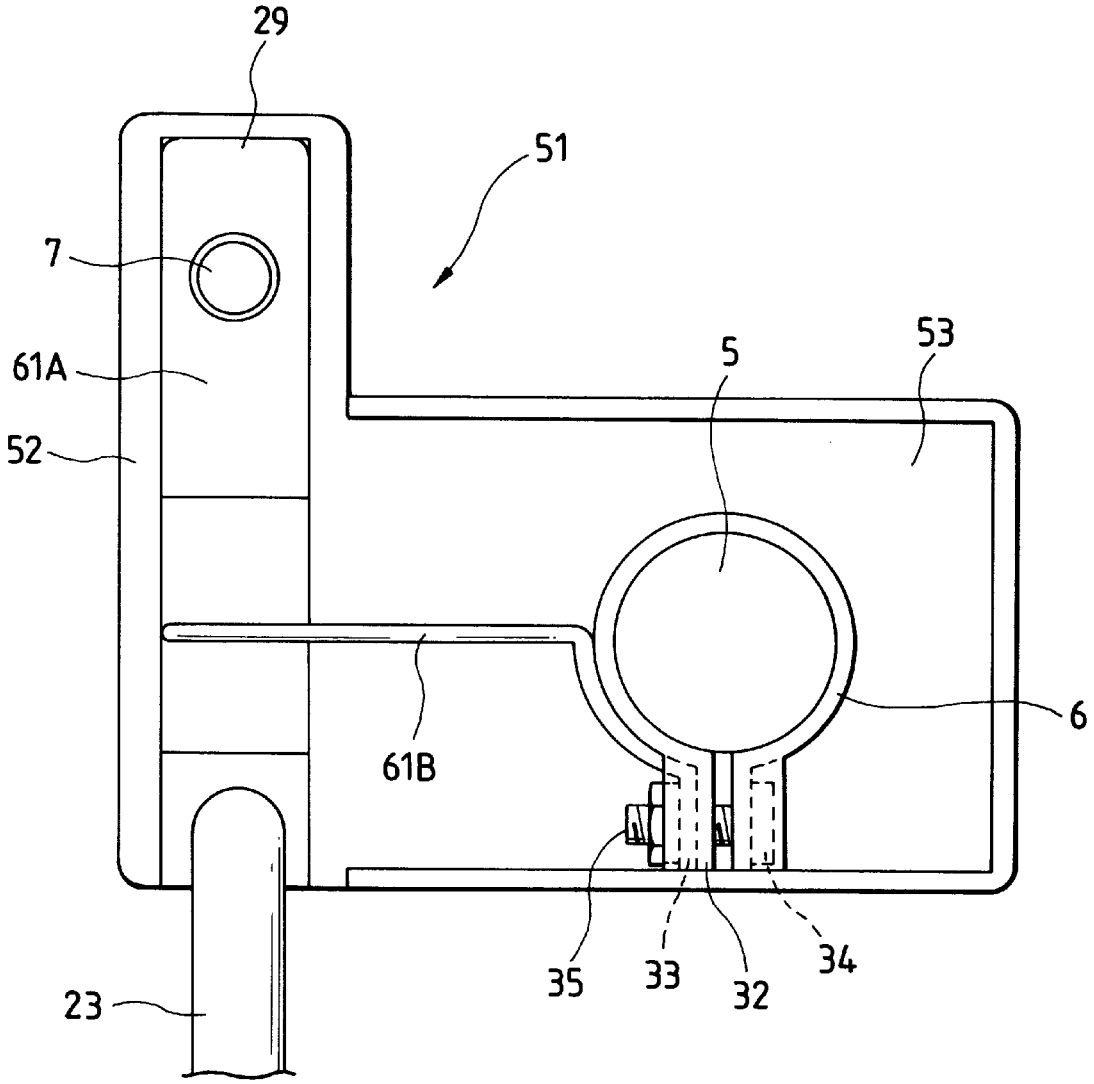
FIG. 6 is a side view.

Inside the casing 55, a plug 63 having a sectional shape like a gate is fitted so as to be slidable vertically. The plug 63 is formed of a conductor, and is bifurcated contact portions 64A an d 64B which are e formed on the opposite side surfaces of the plug 63, so t hat they can be fitted to the socket portions 62A and 62B of above-mentioned bus bars 61A and 61B respectively. Louvers 17 swollen inward elastically are provided in the corresponding surfaces of the contact portions 64A and 64B. An operation rod 66 is provided on a ceiling portion 70 of the plug 63 so as to project therefrom, so that the operation rod 66 can project upward from an escape hole 67 opened in the upper surface of the block portion 52. Therefore, the plug 63 can move between a retreated position where the contact portions 64A and 64B are fitted to the socket portions 62A and 62B of the bus bars 61A and 61B as shown in FIG. 4, and an advanced position where the contact portions 64A and 64B are detached from the socket portions 62A and 62B as shown in FIG. 5.

Figure 7:
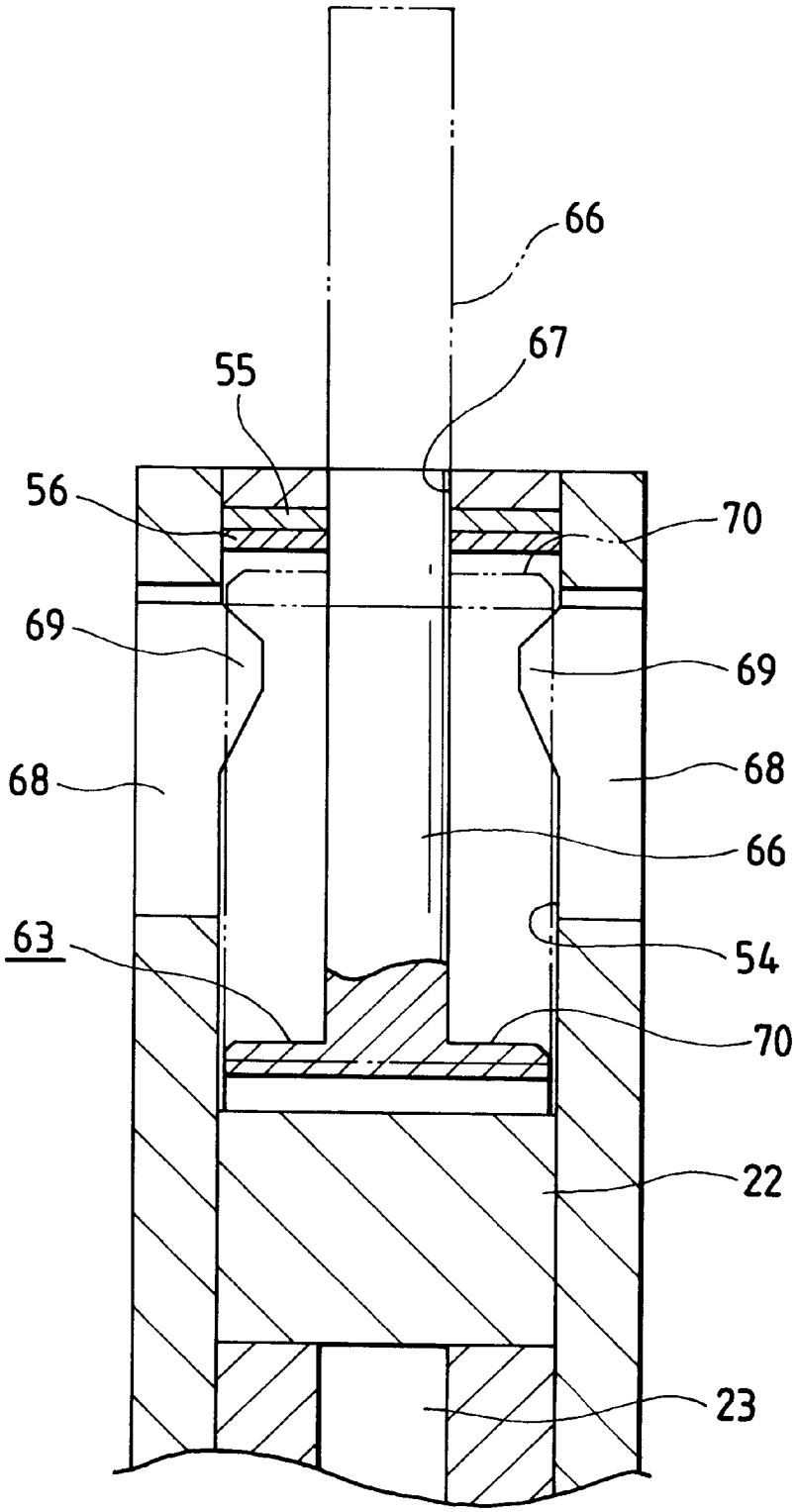
FIG. 7 is a sectional view showing a plug locking structure.

Further, as shown in FIG. 7, flexibly transformable lock pieces 68 are formed on the opposite side walls of the storage chamber 54, and mountain-like protrusion portions 69 are formed thereon, so that the locking pieces 68 can be locked at the opposite side edges of a ceiling portion 70 of the plug 63 when the plug 63 moves to the advanced position.

The casing 55 as mentioned above is assembled on the battery in a state where the plug 63 is positioned in the retreated position in advance. The battery post 5 is fixed to the fastening ring 6. At the same time, a connection portion 33 of one of the bus bars 61B is fixed to a connection plate 32 of the fastening ring 6 so as to contact with each other. Further, a power supply wire is connected to the stud bolt 7. At the same time, a connection portion 29 of the other bus bar 61A is connected to the power supplywire. Thus, there is formed a power supply circuit starting from the battery post 5 to the power supply wire through one of the-bus bars 61B, the plug 63, and the other bus bars 61A. Further, the trigger wire 23 is connected to the battery. The body casing 1 is covered with a cover.

The operation of the second embodiment is described as follows:

When an abnormal signal is sent out with generation of an accident or the like in the vehicle in the state of FIG. 4, a current flows in the trigger wire 23. As a result, the filament in the explosive seal portion 22 generates heat, so that an explosive explodes. The explosion force acts on the lower surface of the ceiling portion 70 of the plug 63 so that the plug 63 is moved upward in the casing 55 to reach the advanced position, as shown in FIG. 5. At that time, the ceiling portion 70 of the plug 63 is locked by the protrusion portions 69 of the lock pieces 68, so that the moving downward of the plug 63 is restricted, as shown by the chain line in FIG. 7. When the plug 63 moves upward to the advanced position, the contact portions 64A and 64B of the plug 63 are detached from the socket portions 62A and 62B of the bus bars 61A and 61B corresponding thereto respectively, so that the plug 63 and the socket portions 62A and 62B are brought into a non-conductive state with each other. Accordingly, the power supply circuit is broken.

Also in this second embodiment, the plug 63 is moved relatively to the socket portions 62A and 62B by use of the explosion force of the explosive to thereby cut the conduction. Therefore, it is possible to break the power supply circuit with a high reliability. Further, when the plug 63 moves to the advanced position, the plug 63 is locked by the protrusion portions 69. Therefore, the plug 63 is prevented from moving downward to the retreated position. Accordingly, unexpected recovery of conduction is prevented.

On the other hand, when the operation rod 66 is pushed as shown by the arrow in FIG. 5, the ceiling portion 70 gets over the protrusion portions 69 while transforming the lock pieces 68 flexibly. Accordingly, the plug 63 is pushed in downward, so that the contact portions 64A and 64B can be plugged into the socket portions 62A and 62B respectively. Therefore, it is possible to recover the conduction of the circuit.

In this second embodiment, the socket portions 62A and 62B are formed from the bus bars 61A and 61B themselves. Accordingly, the structure becomes simple.

Third Embodiment

A third embodiment of the present invention will be described with reference to FIG. 8 to FIG. 10.

In the drawings, the reference numeral 1 represents a body casing which is made of synthetic resin and has such a shape that the post mounting plate 3 is provided so as to project from one side surface of the flat block portion 2 perpendicularly thereto. An insertion hole to which the battery post 5 (see FIG. 10) of the battery (not-shown) mounted on an electric vehicle will be inserted is formed in the post mounting plate 3. The fastening ring 6made of a conductor is disposed thereon. Further, the stud bolt 7 for connecting a not-shown power supply wire is erected on a side surface of the block portion 2.

Figure 8:
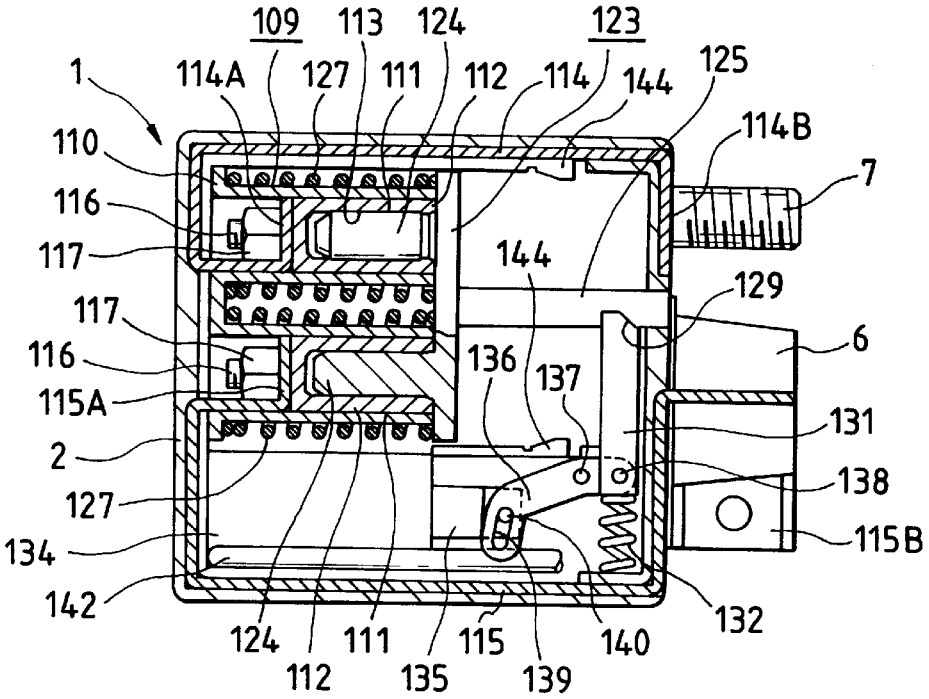
FIG. 8 is a sectional view when a plug of a third embodiment of the present invention is disposed in a retreated position.

A housing 109 for installing a socket is stored in the left upper portion in FIG. 8 inside the block portion 2. This housing 109 has a shape in which two storage cylinders 111 are formed at a distance on a substrate 110. Closed-end cylindrical sockets 112 respectively made of a conductor are fitted to the right end sides of the respective storage cylinders 111. The sockets 112 are formed like louver terminals in which pieces of louvers 113 swollen inward elastically are provided at intervals in the circumferential direction on the inner surfaces of the sockets 112.

Bolts 116 are provided so as to erect on the bottoms of the respective sockets 112, so that bus bars 114 and 115 can be connected to the sockets 112 respectively. The bolt 116 of the upper socket 112 is penetrated by an inner connection portion 114A of the first bus bar 114. The first bus bar 114 is fastened by a nut 117 so as to be connected to the upper socket 112. This first bus bar 114 is disposed so as to extend along the upper wall from the left wall of the block portion 2. An outer connection portion 114B is inserted onto the stud bolt 7 and brought in abutment on the surface where the stud bolt 7 is erected.

On the other hand, the bolt 116 of the lower socket 112 is penetrated by an inner connection portion 115A of the second bus bar 115. The second bus bar 115 is fastened by a nut 117 so as to be connected to the lower socket 112 in the same manner as described above. This second bus bar 115 is disposed so as to extend along the left wall to the lower wall of the block portion 2. An outer connection portion 115B is erected near connection plates 119 of the above-mentioned fastening ring 6, and provisionally connected to the both connection plates 119 by means of a bolt 120 and a nut 121.

Figure 9:
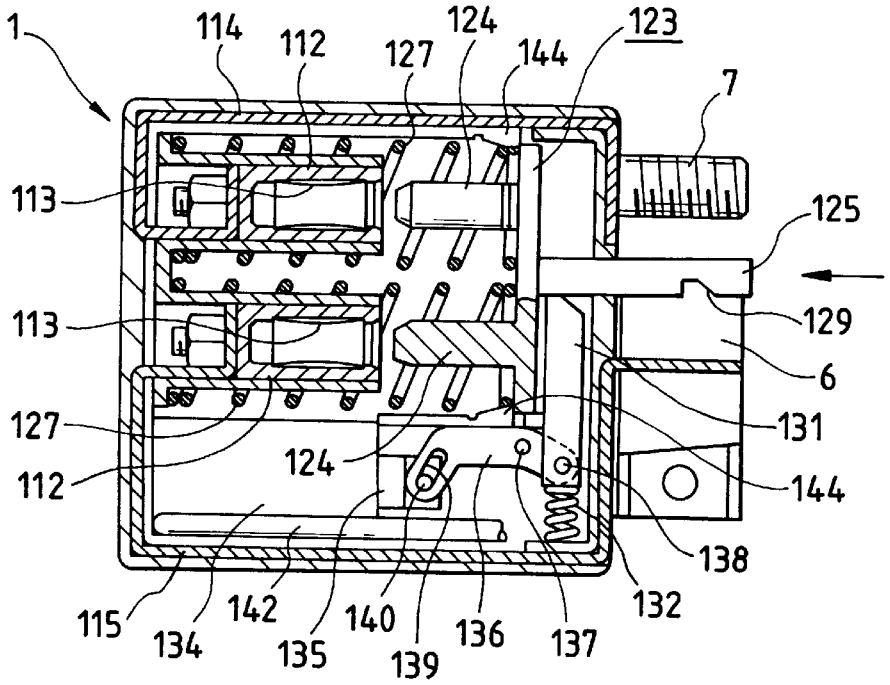
FIG. 9 is a sectional view when the plug is disposed in an advanced position.
Figure 10:
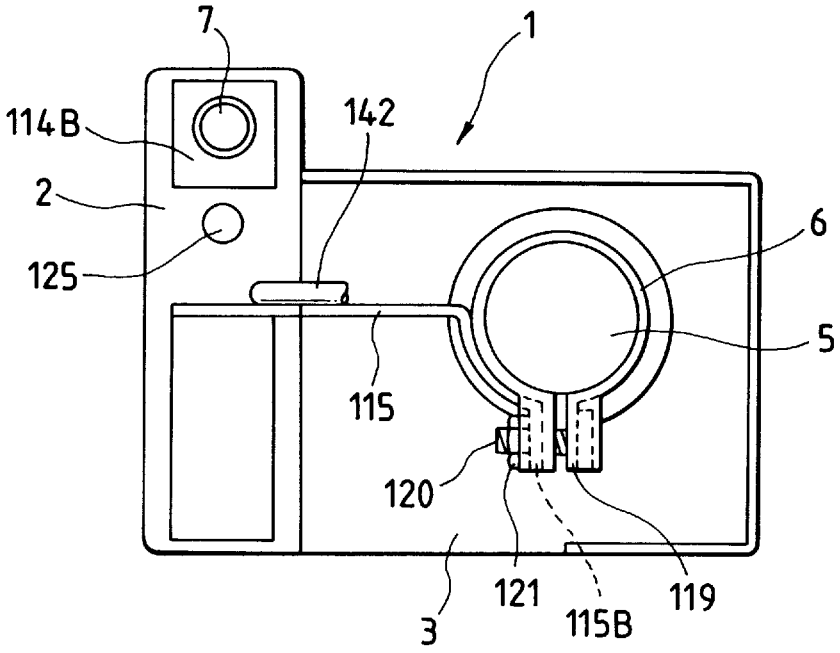
FIG. 10 is a side view.

A plug body 123 formed of a conductor is stored in a space on the right side of the housing 109 so as to be movable between the retreated position shown in FIG. 8 and the advanced position shown in FIG. 9. Two plugs 124 which can be fitted into the above-mentioned respective sockets 112 are erected on the left surface of this plug body 123. On the other hand, an operation rod 125 is erected at the center of the right surface of the plug body 123, so that the operation rod 125 can project from the side surface of the block portion 2.

An urging spring 127 formed from a compression coil spring is fitted to the outer circumference of both storage cylinders 111 of the housing 109. The opposite ends of the urging spring 127 abut against the substrate 110 of the housing 109 and the plug body 123 so that the plug body 123 is urged to move toward the advanced position by the elastic extension force of the urging spring 127.

The front end of the operation rod 125 of the plug body 123 is notched to form a lock groove 129. On the other hand, inside the block portion 2, a stopper 131 the front end portion of which can be fitted into the above-mentioned lock groove 129 is stored so as to be movable forward and backward in the direction perpendicular to the axial direction of the operation rod 125. This stopper 131 is urged to move forward by an auxiliary urging spring 132 attached to the rear end side of the stopper 131. When the plug body 123 is pushed into the retreated position while the plug body 123 elastically compresses the urging spring 127, the stopper 131 is fitted into the lock groove 129 of the operation rod 125, as shown in FIG. 8. As a result, the plug body 123 is locked in the retreated position. In this retreated position, the plugs 124 are inserted into the corresponding sockets 112 respectively so as to be connected to sockets 112 respectively.

In a space under the housing 109, a solenoid 134 is stored in such a position in which a plunger 135 of the solenoid 134 is projected to the right. Between the solenoid 134 and the stopper 131, a lever 136 is supported so as to bepivotable about a shaft 137. One end of the lever 136 is coupled with a base end portion of the stopper 131 through a pin 138. A cam groove 139 is formed in the other end of the lever 136, and a pin 140 erected on the plunger 135 is fitted into the cam groove 139.

A trigger wire 142 connected to the solenoid 134 is led to the outside of the body casing 1. When the solenoid 134 is in a non-excitation state, the plunger 135 is disposed in a forward position as shown in FIG. 8. When the solenoid 134 is excited so that the plunger 135 moves backward, clockwise rotation force in FIG. 8 is given to the lever 136 by the engagement of the pin 140 and the cam groove 139.

Further, a pair of flexibly transformable detent nails 144 are provided on each of the bottom and upper surfaces of the block portion 2. When the plug body 123 moves into the advanced position, the detent nails 144 are locked by the side edges of the plug body 123 so that the movement of the plug body 123 to the retreated position is restricted.

Such a body casing 1 as mentioned above is assembled on the battery. At that time, the plug body 123 is disposed in the retreated position in advance, as shown in FIG. 8. When the battery post 5 is inserted into the fastening ring 6, and the connection plates 119 are fastened by the bolt 120 and the nut 121, the fastening ring 6 is diminished in diameter and fixed to the battery post 5. At the same time, the battery post 5 and the outer connection portion 11SB of the second bus bar 115 are connected through the fastening ring 6. Further, a connection terminal of a not-shown power supply wire is fitted to the stud bolt 7, and the connection terminal is pressed and fixed to the outer connection portion 114B of the first bus bar 114 by a nut (not-shown).

Thus, a power supply circuit starting from the battery post 5 to the power supply wire through the second bus bar 115, the lower socket 112 and plug 124, the upper plug 124 and socket 112, and the first bus bar 114 is formed as shown in FIG. 8. Further, the trigger wire 142 is also connected to the battery side. The body casing 1 is covered with a cover.

This third embodiment has such a structure as mentioned above. Next, the operation of the third embodiment is described as follows:

When an abnormal signal is sent out with generation of an accident or the like in the vehicle in the state of FIG. 8, a current flows in the trigger wire 142. As a result, the solenoid 134 is excited so that the plunger 135 moves backward. According to moving backward of the plunger 135, the lever 136 pivots clockwise in FIG. 8, and the stopper 131 moves backward against the elastic force of the auxiliary urging spring 132 so that the stopper 131 separates from the lock groove 129. Then, the plug body 123 is moved to the advanced position by the elastic force of the urging spring 127 as shown in FIG. 9 so that the plug body 123 is locked by the detent nails 144. When the plug body 123 reaches the advanced position, the plugs 124 are drawn out from the corresponding sockets 112 respectively so that the plugs 124 are in a non-conductive state. Consequently, the power supply circuit is broken.

Meanwhile, although the excitation of solenoid 134 is released excitation, the upward movement of the stopper 131 and the forward movement of the plunger 135 are restricted because the front end of the stopper 131 abuts against the operation rod 125.

Therefore, in this third embodiment, conduction is cut by drawing-out of the plugs 124 from the sockets 112 by use of the urging force of the urging spring 127. Accordingly, it is possible to break the power supply circuit with a high reliability and at a high speed.

On the other hand, when the operation rod 125 is pushed in as shown by the arrow in FIG. 9, the plug body 123 is returned to the retreated position against the elastic force of the urging spring 127 while the detent nails 144 are bent and transformed. When the plug body 123 is returned to its normal position, the stopper 131 is fitted into the lock groove 129 by the elastic force of the auxiliary urging spring 132 to thereby lock the plug body 123. In this retreated position, it is possible to recover the conduction of the circuit because the plugs 124 are connected to the sockets 112 in such a manner as mentioned above.

Fourth Embodiment

Figure 13:
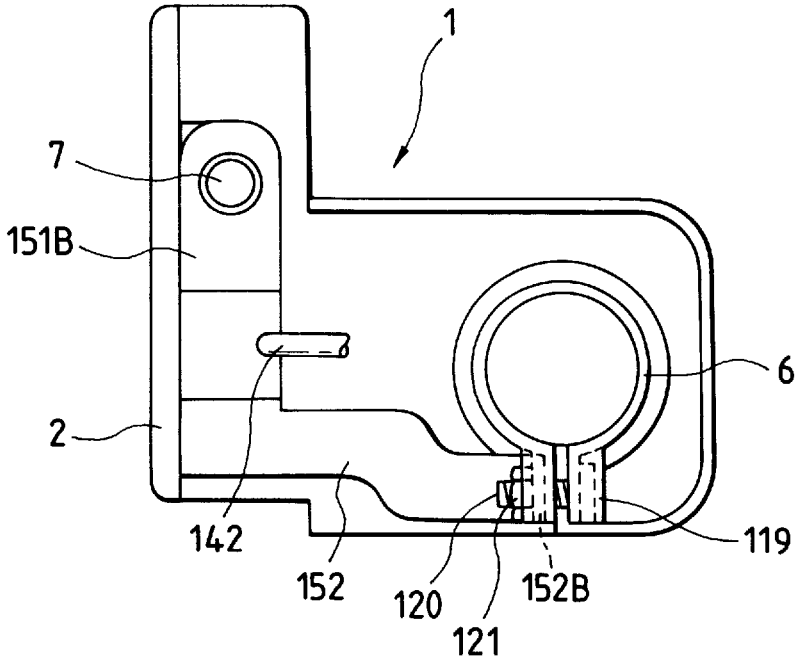
FIG. 13 is a side view.

A fourth embodiment of the present invention will be described with reference to FIG. 11 to FIG. 13. Here the internal structure is shown in a simplified manner. Further, portions having the same functions as those in the third embodiment are referenced correspondingly, and their description will be omitted or made simply.

An outer connection portion 151B of a first bus bar 151 abuts against a surface where the stud bolt 7 is erected, while an inner connection portion 151A of the same is disposed inside the block portion 2. On the other hand, an outer connection portion 152B of a second bus bar 152 is provisionally assembled together with connection plates 119 of the fastening ring 6 by means of a bolt 120 and a nut 121, while an inner connection portion 152A of the same is disposed in opposition to the inner connection portion 151A of the above-mentioned first bus bar 151. Sockets 153 respectively formed of a conductor are fastened by nuts 154 so as to be fixed to the inner connection portions 151A and 152A respectively. These sockets 153 are formed like louver terminals in which pieces of louvers 113 swollen inward elastically are provided at intervals in the circumferential direction on the inner surfaces of the sockets 153.

Figure 11:
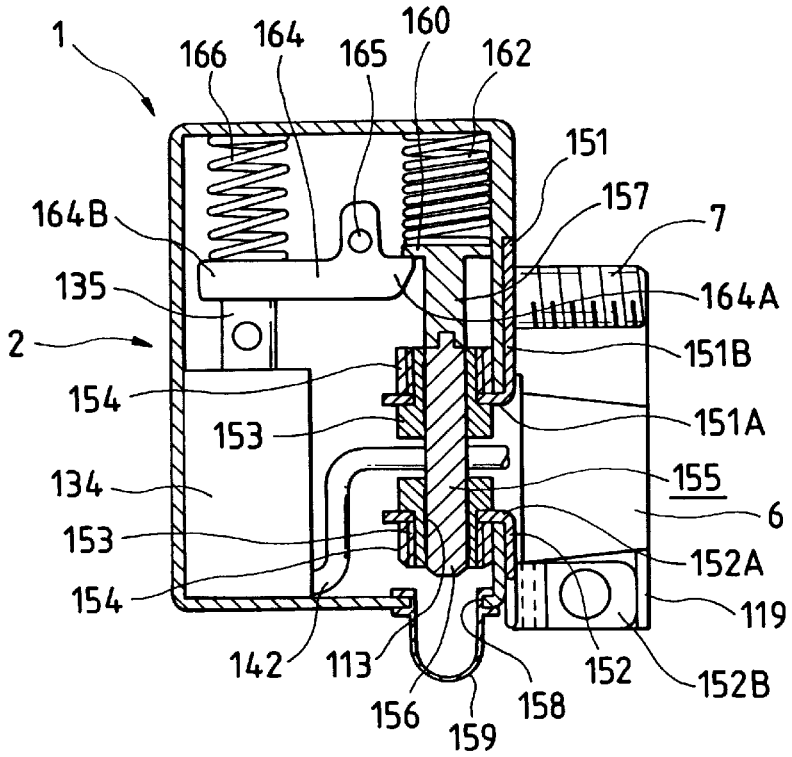
FIG. 11 is a sectional view when a plug of a fourth embodiment is disposed in a retreated position.
Figure 12:
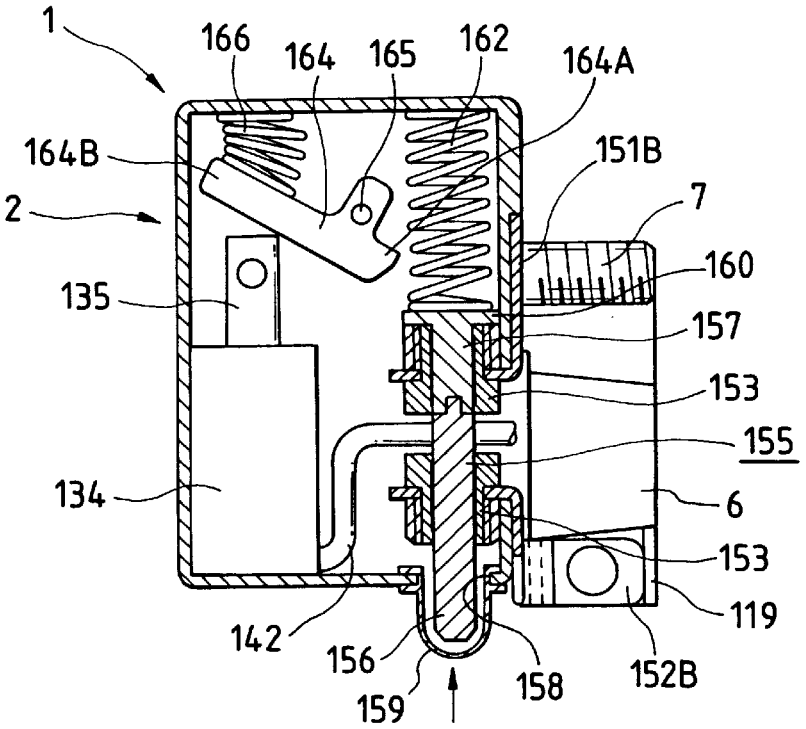
FIG. 12 is a sectional view when the plug is disposed in an advanced position.

A plug 155 is slidably fitted between the sockets 153 so as to be movable between the retreated position shown in FIG. 11 and the advanced position shown in FIG. 12. This plug 155 is formed from a conductor portion 156 made of conductive material only at a front end portion and an insulating portion 157 made of insulating material at abase end potion. Therefore, the conductor portion 156 enters the sockets 153 to extend over the both sockets 153 when the plug 155 is disposed in the retreated position shown in FIG. 11. When the plug 155 is disposed in the advanced position shown in FIG. 12, the insulating portion 157 gets into the upper socket 153 over its whole length. An escape hole 158 for projecting the front end of the plug 155 is formed in the lower wall of the block portion 2, and is closed by a button cap 159 made of rubber. A flange 160 is formed at the upper end of the plug 155, and an urging spring 162 for urging the plug 155 to move forward is attached upon the flange 160.

On the left side of the position where the socket 153 is disposed, a solenoid 134 is provided to look upward. A trigger wire 142 connected to the solenoid 134 is led to the outside of the body casing 1. Between the solenoid 134 and the plug 155, a lever 164 is supported so as to be pivotable about a shaft 165. A lock end 164A at one end of the lever 164 can be locked by the flange 160 of the plug 155, while an abutment end 164B at the other end can abut against the plunger 135 of the solenoid 134. A return spring 166 is attached above the abutment end 164B of the lever 164 so as to give counterclockwise rotation force to the lever 164.

In an assembled state with the battery, the plug 155 is locked in the retreated position in FIG. 11 so that a first bus bar 151 is connected to a power supply wire which is connected to the stud bolt 7, while a second bus bar 152 is connected to the battery post 5 through the fastening ring 6. Thus, there is formed a power supply circuit starting from the battery post 5 to the power supply wire through the second bus bar 152, the lower socket 153, the conductor portion 156 of the plug 155, the upper socket 153, and the first bus bar 151. Further, the trigger wire 142 is also connected to the battery.

The operation of the fourth embodiment is described as follows:

When an abnormal signal is sent out with generation of an accident or the like in the vehicle in the state of FIG. 11, a current flows in the trigger wire 142 so that the solenoid 134 is excited to make the plunger 135 move forward. The lever 164 pivots clockwise against the elastic force of the return spring 166 so that the lock end 164A of the lever 164 releases the lock in the flange 160. As a result, the plug 155 is moved advanced by the elastic force of the urging spring 162 so that the plug 155 reaches the advanced position shown in FIG. 12. Here, there is a non-conductive state between the plug 155 and the upper socket 153 because the insulating portion 157 enters the upper socket 153. Consequently, the power supply circuit is broken.

Also in this fourth embodiment, conduction is cut by the movement of the plug 155 relative to the socket 153 by use of the urging force of the urging spring 162. Accordingly, it is possible to break the power supply circuit with a high reliability and at a high speed. Further, the conduction is cut through the insulating portion 157. It is therefore possible to make a non-conductive state more surely.

On the other hand, when the plug 155 is pushed through the button cap 159 into the retreated position against the elastic force of the urging spring 162 as shown by the arrow in FIG. 12, and at the same time, when the excitation of the solenoid 134 is released, the lever 164 is pivoted counterclockwise by the elastic force of the return spring 166 so that the lever 164 is locked by the flange 160 while the plunger 135 is moved backward. As a result, the plug 155 is held in the retreated position, and the conduction of the circuit is recovered.

Fifth Embodiment

Figure 15:
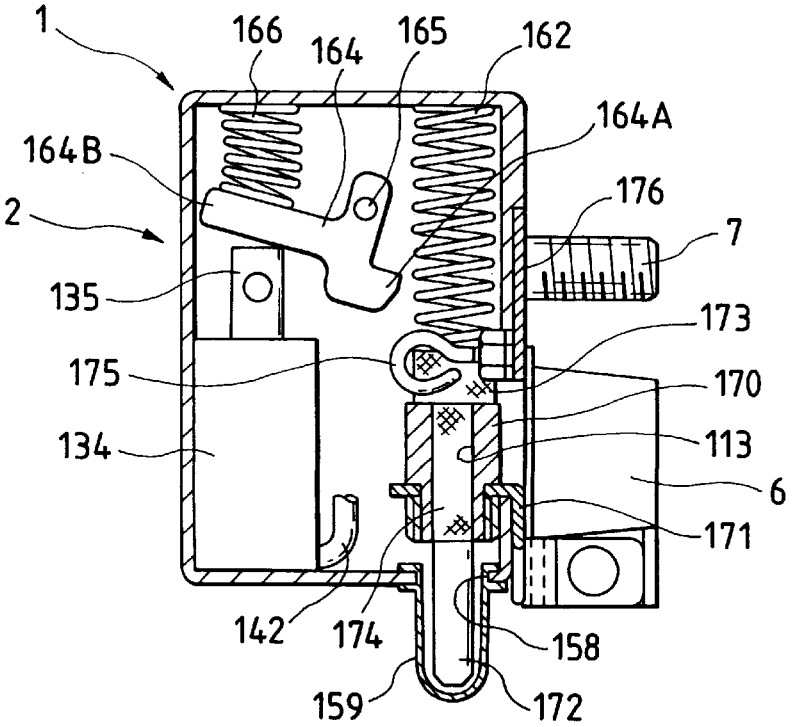
FIG. 15 is a sectional view when the plug is disposed in an advanced position.
Figure 16:
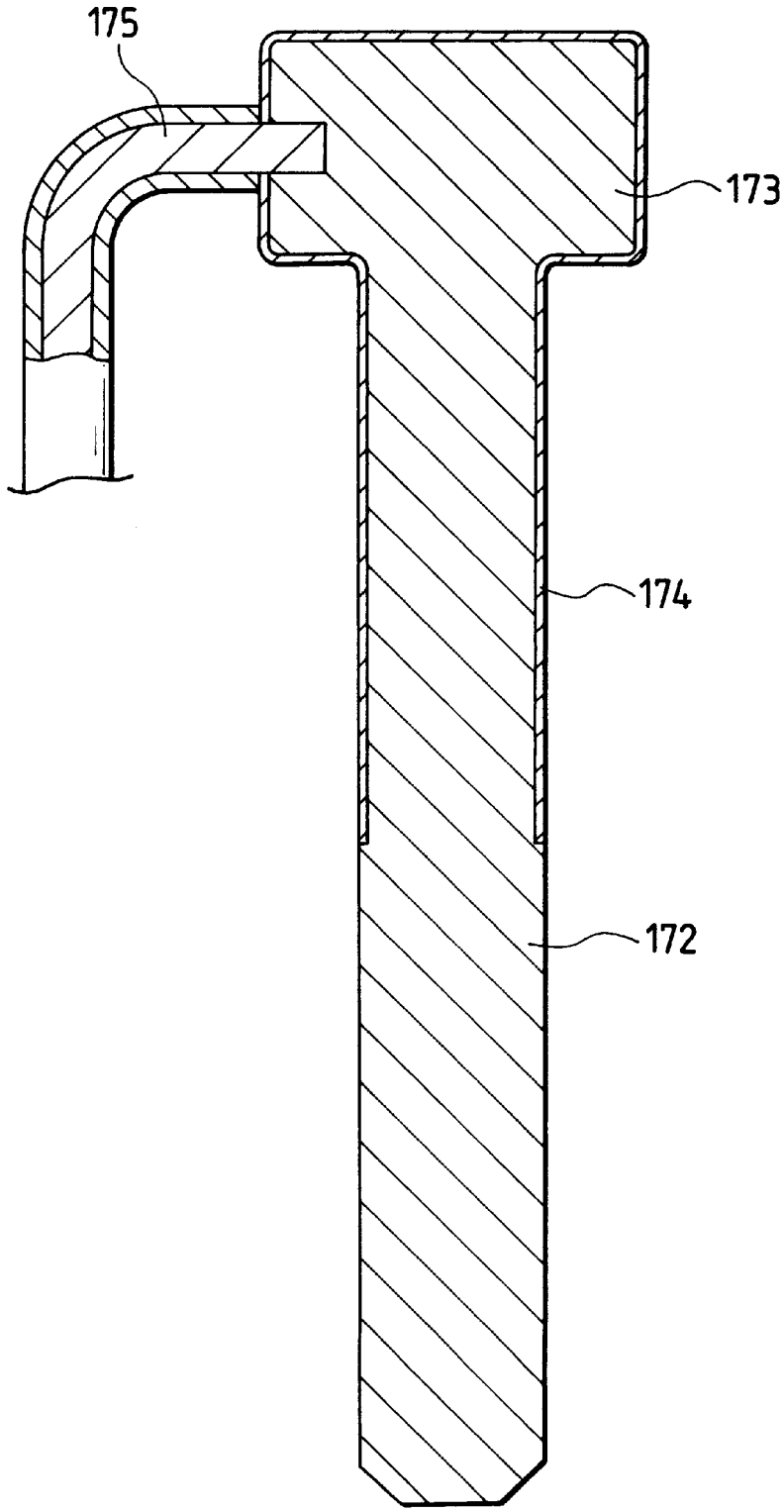
FIG. 16 is an expanded sectional view of the plug.
Figure 17:
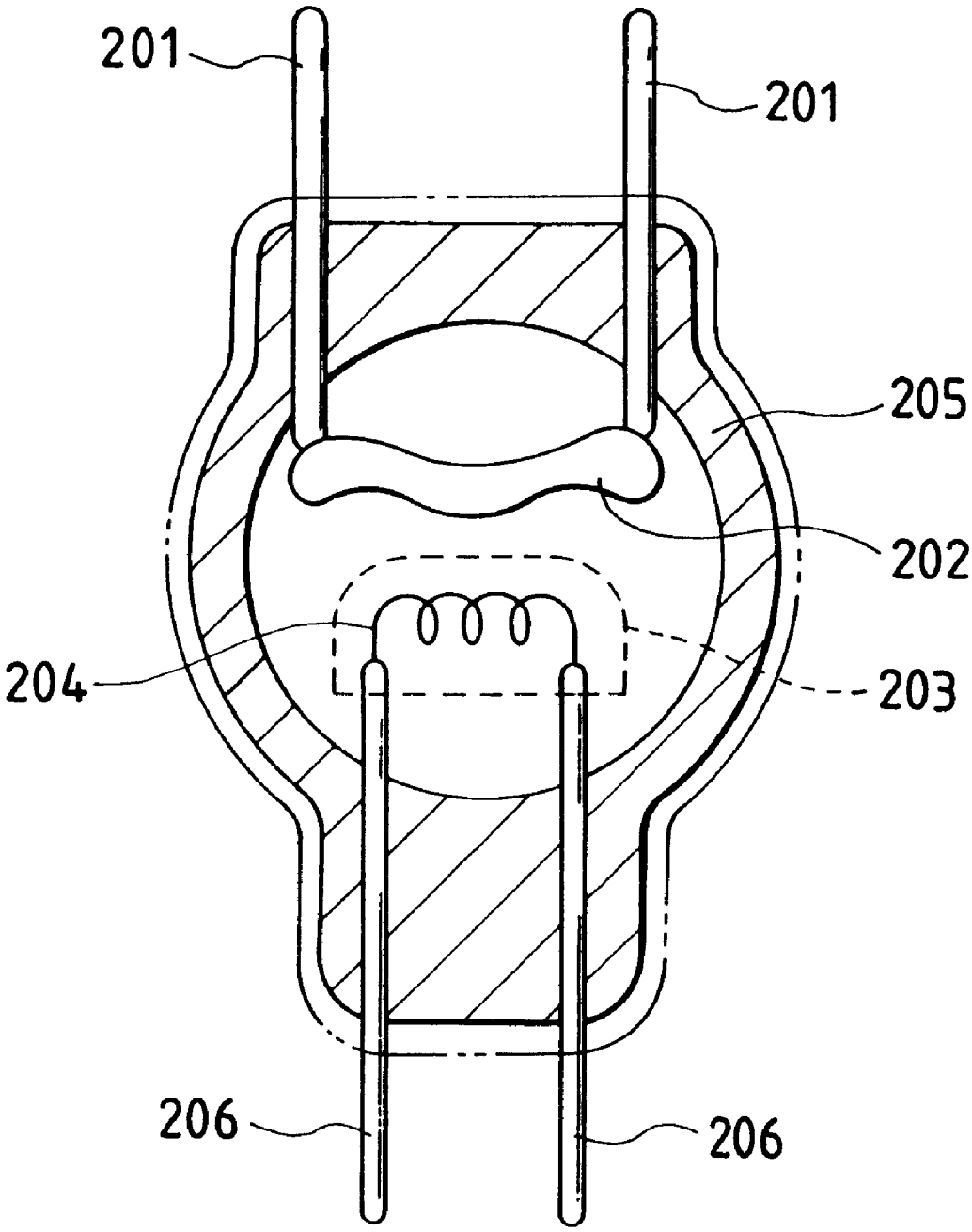
FIG. 17 is a sectional view of a conventional example.

A fifth embodiment of the present invention will be described with reference to FIG. 14 to FIG. 16. In this fifth embodiment, only one socket 170 like a louver terminal is provided, and connected, through a bus bar 171, to the fastening ring 6 for locking the battery post 5. Inside this socket 170, a plug 172 is inserted so as to be slidable between a retreated position shown in FIG. 14 and an advanced position shown in FIG. 15. Through being made of conductive material, the plug 172 is coated with an insulating layer 174 from the base end side to the outer circumference of the flange 173 as shown in detail in FIG. 9. One end of a connection wire 175 is connected to a solid portion of the flange 173, while the other end is connected to a bus bar 176 abutting against the surface where the stud bolt 7 is erected.

The plug 172 is urged to move advanced by an urging spring 162. The plug 172 is kept in the retreated position because a lock end 164A of a lever 164 is locked by the flange 173. The conductive portion of the plug 172 is connected to the socket 170 in the retreated position, while the portion provided with the insulating layer 174 is fitted into the socket 170 when the plug 172 reached the advanced position. Since the other structure is substantially the same as that in the fourth embodiment, portions having the same function are reference correspondingly, and duplicate description about them will be omitted here.

Figure 14:
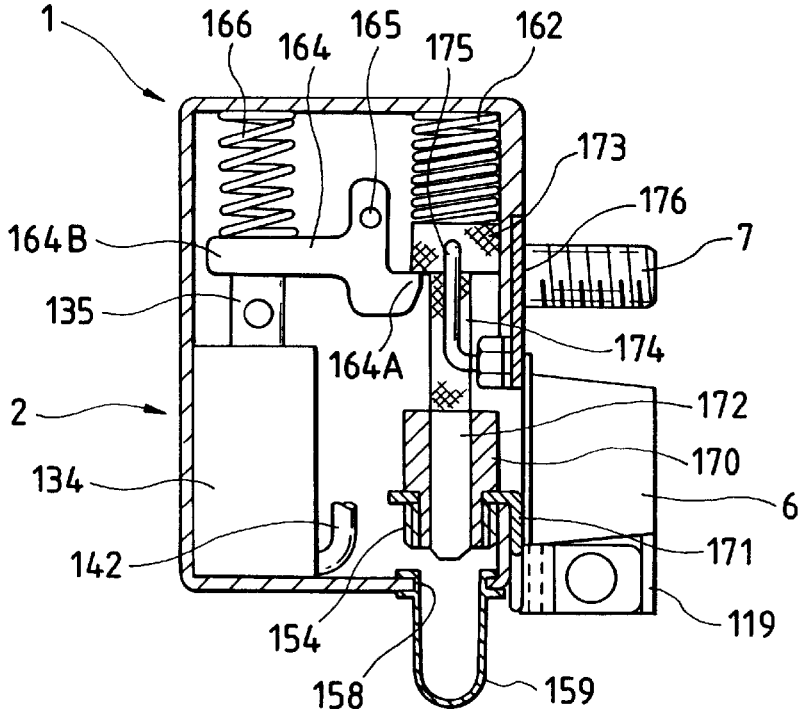
FIG. 14 is a sectional view when a plug of a fifth embodiment is disposed in a retreated position.

The operation of the fifth embodiment is described as follows:

When an abnormal signal is sent out with generation of an accident or the like in the vehicle in the state of FIG. 14, a current flows in the trigger wire 142. As a result, the solenoid 134 is excited so that the plunger 135 is moved forward. With the movement of the plunger 135, the lever 164 pivots clockwise against the elastic force of the return spring 166, and the lock end 164A of the lever 16-4 releases the lock by the flange 173. As a result, the plug 172 is moved advanced by the elastic force of the urging spring 162 so that the plug 172 reaches the advanced position shown in FIG. 14. Here, the plug 172 and the socket 170 are in a non-conductive state because the portion provided with the insulating layer 174 enters the socket 170. Consequently, the power supply circuit is broken.

Also in this fifth embodiment, conduction is cut by the movement of the plug 172 relative to the socket 170 by the urging force of the urging spring 162. Accordingly, it is possible to break the power supply circuit with a high reliability and at a high speed. When the plug 172 is pushed through the button cap 159 into the retreated position against the elastic force of the urging spring 162, and at the same time when the excitation of the solenoid 134 is released, the lever 164 is pivoted counterclockwise by the elastic force of the return spring 166, so as to be locked by the flange 173 while the plunger 135 is moved backward. As a result, the plug 172 is held in the retreated position, and the conduction of the circuit is recovered.

The present invention is not limited to the above description and the embodiments described with the drawings. For example, the following embodiment is also included in the technical scope of the present invention. Further, various modifications as well as the following one can be carried out within a scope not-departing from-the gist of the present invention.

For example, in the fourth embodiment, it is possible to set a conductive state when the plug is disposed in the advanced position and a non-conductive state when the plug is disposed in the retreated position. In this case, the plug is designed so as to be pulled toward the retreated position by a tension coil spring to reverse-the direction of lock so that the plug may be locked in the advanced position.

The present invention is not limited to a power supply circuit of an electric vehicle shown in the above-mentioned embodiments by way of example, but it is applicable broadly and generally to circuits which require emergency breaking.

What is claimed is:

1. A circuit breaking device comprising:

a socket provided on the way of a circuit;

a plug movably disposed in a direction that said plug is inserted into and removed from said socket; and an explosive exploding in response to a trigger signal given thereto to thereby drive said plug by explosion force to move advanced;

wherein said plug is normally disposed in a retreated position at where said plug is in a conductive state with said socket, while said plug is in a non-conductive state with said socket when said plug moves to an advanced position.

2. The circuit breaking device according to claim 1, wherein said plug includes a conductor portion and an insulating portion which are provided continuously so that said conductor portion is connected to said socket when said plug is disposed in said retreated position, while said insulating portion is contacted to said socket when said plug is disposed in said advanced position.

3. The circuit breaking device according to claim 1, wherein said device further comprises detent means for locking said plug in a state of detention when said plug moves to said advanced position.

4. The circuit breaking device according to claim 3, wherein when a force greater than or equal to a predetermined force is made to act on said plug, said detent means releases its lock to allow said plug to return said retreated position, thereby the conduction of the circuit is recovered.

5. A circuit breaking device comprising:

a socket provided on the way of a circuit;

a plug removably inserted into said socket, and movably disposed between a retreated position where said plug is brought into conduction with said socket and a advanced position where said plug is brought into non-conduction with said socket;

urging means for urging said plug to move toward said advanced position;

lock means for locking said plug in said retreated position against urging force of said urging means; and release means for releasing said plug from lock by said lock means in response to a trigger signal given thereto.

6. The circuit breaking device according to claim 5, wherein said plug includes a conductor portion and an insulating portion which are provided continuously so that said conductor portion is connected to said socket when said plug is disposed in said retreated position, while said insulating g portion is contacted to said socket when said plug is disposed in said advanced position.

7. The circuit breaking device according to claim 5, wherein said plug is locked in said retreated position again by said lock means when said plug is pushed from said advanced position, thereby the conduction of the circuit is recovered.

8. The circuit breaking device according to claim 2, wherein said device includes at least two sockets, said conductor portion of said plug extends over the two sockets when said plug is disposed in said retreated position, while said conductor portion of said plug is connected to one socket and said insulating portion of said plug is contacted to the other socket when said plug is disposed in said advanced position.

9. The circuit breaking device according to claim 8, wherein said device further comprises, a fasten ring fastening a battery post of a battery, said fastening ring electrically connected to said one socket; and a stud bolt connected to a connection terminal of a power supply wire, said stud bolt electrically connected to the other socket.

10. The circuit breaking device according to claim 6, wherein said device includes at least two sockets, said conductor portion of said plug extends over the two sockets when said plug is disposed in said retreated position, while said conductor portion of said plug is connected to one socket and said insulating portion of said plug is contacted to the other socket when said plug is disposed in said advanced position.

11. The circuit breaking device according to claim 10, wherein said device further comprises, a fasten ring fastening a battery post of a battery, said fastening ring electrically connected to said one socket; and a stud bolt connected to a connection terminal of a power supply wire, said stud bolt electrically connected to the other socket.

12. The circuit breaking device according to claim 1, wherein said plug includes a conductor portion, said conductor portion being connected to a socket portion when said plug is disposed in said retreated position, while said conductor portion being completely detached from said socket portion when said plug is disposed in said advanced position.

13. The circuit breaking device according to claim 12, wherein said device includes two socket portions, said conductor portion of said plug connects the two socket portions when said plug is disposed in said retreated position, while said conductor portion of said plug is completely detached from said socket portion when said plug is disposed in said advanced position.

14. The circuit breaking device according to claim 13, wherein said device further comprises, a fasten ring fastening a battery post of a battery, said fastening ring electrically connected to said one socket portion; and a stud bolt connected to a connection terminal of a power supply wire, said stud bolt electrically connected to the other socket portion.

15. The circuit breaking device according to claim 5, wherein said plug includes a conductor portion, said conductor portion being connected to said socket when said plug is disposed in said retreated position, while said conductor portion being completely detached from said socket portion when said plug is disposed in said advanced position.

16. The circuit breaking device according to claim 15, wherein said device includes at least two sockets, said conductor portion of said plug connects the two sockets when said plug is disposed in said retreated position, while said conductor portion is completely detached from the two sockets when said plug is disposed in said advanced position.

17. The circuit breaking device according to claim 16, wherein said device further comprises, a fasten ring fastening a battery post of a battery, said fastening ring electrically connected to said one socket; and a stud bolt connected to a connection terminal of a power supply wire, said stud bolt electrically connected to the other socket.

18. The circuit breaking device according to claim 6, wherein said conductor portion of said plug connects said socket when said plug is disposed in said retreated position, while said insulating portion of said plug is contacted to said socket when said plug is disposed in said advanced position.

19. The circuit breaking device according to claim 18, wherein said device further comprises, a fasten ring fastening a battery post of a battery, said fastening ring electrically connected to said one socket; and a stud bolt connected to a connection terminal of a power supply wire, said stud bolt electrically connected to said conductor portion of said plug.

* * * * *